US007128317B2

(12) United States Patent
Johnson et al.

(10) Patent No.: US 7,128,317 B2
(45) Date of Patent: Oct. 31, 2006

(54) MOVEABLE MEDIA DAM

(75) Inventors: Kevin M. Johnson, Georgetown, KY (US); Michael W. Lawrence, Lexington, KY (US); Bryan C. Scharf, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 109 days.

(21) Appl. No.: 10/938,001

(22) Filed: Sep. 10, 2004

(65) Prior Publication Data

US 2006/0071400 A1 Apr. 6, 2006

(51) Int. Cl.
*B65H 3/52* (2006.01)

(52) U.S. Cl. ..... 271/121; 271/124

(58) Field of Classification Search ..... 271/124, 271/121, 245, 122; 74/567, 569, 54, 47–50, 74/96, 98, 97.2
See application file for complete search history.

(56) References Cited

U.S. PATENT DOCUMENTS 4,822,023 A * 4/1989 Miyoshi ..... 271/118
5,029,839 A * 7/1991 Kajiwara et al. ..... 271/121
5,316,285 A * 5/1994 Olson et al. ..... 271/122
5,358,230 A * 10/1994 Ikemori et al. ..... 271/114
5,370,380 A * 12/1994 Suzuki et al. ..... 271/21
5,655,762 A * 8/1997 Yergenson ..... 271/121
5,899,450 A * 5/1999 Gettelfinger et al. ..... 271/121
5,979,092 A * 11/1999 Liu ..... 40/411
6,059,281 A * 5/2000 Nakamura et al. ..... 271/119
6,086,062 A * 7/2000 Nakamura et al. ..... 271/121
6,139,007 A * 10/2000 Cahill et al. ..... 271/121
6,199,855 B1 * 3/2001 Choeng et al. ..... 271/122
6,217,017 B1 * 4/2001 Yamazaki ..... 271/121
6,279,897 B1 * 8/2001 Richards ..... 271/121
6,382,621 B1 * 5/2002 Inoue et al. ..... 271/120
6,382,857 B1 * 5/2002 Yanagi et al. ..... 400/636
6,478,295 B1 * 11/2002 Hwang et al. ..... 271/115
6,598,873 B1 * 7/2003 Takisawa et al. ..... 271/246
6,626,595 B1 * 9/2003 Kabamoto ..... 400/624
6,663,098 B1 * 12/2003 Teo et al. ..... 271/121
6,710,971 B1 * 3/2004 Nawa ..... 360/96.5
6,824,132 B1 * 11/2004 Asai et al. ..... 271/125
6,877,738 B1 * 4/2005 Sonoda et al. ..... 271/121
6,880,821 B1 * 4/2005 Park ..... 271/121
6,893,013 B1 * 5/2005 Spitz et al. ..... 271/104
6,896,253 B1 * 5/2005 Hanabusa ..... 271/117
2002/0074711 A1 6/2002 Higaki
2002/0158407 A1 * 10/2002 Hsiao et al. ..... 271/245
2002/0171193 A1 * 11/2002 Asai et al. ..... 271/121
2002/0175462 A1 * 11/2002 Sonoda et al. ..... 271/121
2003/0201596 A1 * 10/2003 Teo et al. ..... 271/121
2004/0065992 A1 4/2004 Youn
2004/0124576 A1 * 7/2004 Spitz et al. ..... 271/18
2004/0251592 A1 * 12/2004 Ruhe et al. ..... 271/109
2006/0038339 A1 * 2/2006 Shimamura ..... 271/121

* cited by examiner

*Primary Examiner*—Eileen D. Lillis
*Assistant Examiner*—Jeremy R Severson
(74) *Attorney, Agent, or Firm*—James Earl Cole

(57) ABSTRACT

A moveable media dam comprises a media dam rotatably connected to a dam shaft, the dam shaft extending from a lever. An arm has at least one camming member and the lever is engaged by the at least one camming member. The arm operably engages a gear train and further comprises an arm ring disposed over a gear of the gear train. The media dam is moveable between a first and second position. The device functions to clear a media feed zone and align leading edges of media sheets in order to inhibit multi-sheet feeds.

21 Claims, 8 Drawing Sheets

MOVEABLE MEDIA DAM

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTINGS, ETC.

None.

BACKGROUND

1. Field of the Invention

The present invention provides a moveable media or paper dam. More specifically, the present invention provides a moveable media dam for a peripheral device which clears media from a feed zone and aligns leading edges of a stack of input media thereby inhibiting multi-sheet feeds.

2. Description of the Related Art

L-path media feed systems have been used for media handling devices such as stand-alone printers and multi-functions devices. In L-path media feed systems, the input media is positioned at the rear of the device in a nearly vertical orientation. The L-path media feed system further comprises a substantially horizontal output tray and a printing zone defined between the input tray and the output tray. The media is moved through a feed path from the near vertical orientation to a substantially horizontal orientation. Thus when viewed from a side, the media moves through a substantially L-shaped path.

However, L-path media feeds have several shortcomings. First, L-path media feed devices have a large height dimension because of the input tray extending upwardly from the peripheral to support input media. Thus, placement of the device on a shelf or cabinet may be difficult. In addition, media loading may also be problematic when the peripheral is placed within the shelf or cabinet because the media generally extends above the input tray. Second, since the media extends above the input tray it is visible to those around the machine, which is generally not aesthetically pleasing to many users. Finally, L-path media feeds are prone to multi-sheet feed problems because of the orientation of the input media. More specifically, the input media is continuously forced downward into a pick area by gravity due to the nearly vertical orientation of the media. As a result of the continuous force on the input media, friction bucklers are utilized to inhibit movement of more than one sheet of media from the input tray to a feed area. However, the friction bucklers may mark and/or bend the media in addition to being an added expense to manufacturers and consumer.

Alternatively, a C-path media feed has also been used in printers and multifunction devices. In general, a C-path media feed utilizes a substantially horizontally disposed input tray adjacent a substantially horizontally disposed output tray and because of this orientation friction bucklers may be removed. Typically, the input tray is positioned beneath the output tray and, as such, is also known as a bottom loading device. The feed path is generally curved from the input tray to the print zone and further to the output tray in order to move the media through a print zone and from a side resembles a substantially C-shaped path. Due to the construction of the C-path media feed, the height of the peripheral or printer is generally decreased because the large upwardly extending media tray used with L-path media feeds is removed. Further, the media is generally hidden from view within the interior of the printer or multi-function device, which is aesthetically pleasing. Finally, with the input tray oriented horizontally, the C-path feed device reduces multi-sheet feed problems due to gravity which are typically associated with L-path media feeds.

Upon changing to a C-path feed system and removing the friction bucklers a further difficulty has arisen. When the friction bucklers are removed, a user may not receive positive feedback that the media is completely inserted into the media tray. Previously such feedback was provided by the bucklers. Without such positive feedback, the user may force the media beyond the rear wall of the input tray and into the feed zone resulting in multi-sheet feeds and media jams. This is highly unacceptable.

Also problematic are multi-sheet feeds of next-to-top sheets caused by friction induced creep. When printing or scanning is performed by a media feed system the media may be continuously fed one sheet after another, starting with an uppermost sheet of the media stack. However, prior art media feeding mechanisms tend to simultaneously feed more than one sheet of the media which is commonly referred to as friction induced creep. The media creep of the next-to-top sheets is generally caused by friction between the uppermost sheet and the next-to-top sheets. Specifically, as the top sheet is picked from an input tray, the next-to-top sheet or sheets, are often partially drawn into the feed mechanism by frictional forces between the top fed sheet and those beneath it. If these next-to-top sheets are not cleared from the feed zone, then multiple sheets may be drawn into the feed zone during a pick cycle resulting in a multi-sheet feed. Multi-sheet feeds are a common problem associated with printers, copiers and other peripheral devices having media feed mechanisms.

Given the foregoing, it will be appreciated that an apparatus is needed which provides a user with positive feedback that a media stack is fully inserted into a media tray. It is further appreciated that a device is needed which aligns the leading edges of the media stack between sheets feeds to negate the effects of media creep and thereby inhibit multi-sheet feeds.

SUMMARY OF THE INVENTION

A moveable media dam, comprises a media dam rotatably connected to a dam shaft, the dam shaft extending from a lever. An arm has at least one camming member and the lever is engaged by the at least one camming member. The arm operably engages a gear train and further comprises an arm ring disposed over a gear of the gear train. The gear has an arm ring engagement surface and the arm ring engages the arm ring engagement surface. The device further comprises a retaining spring disposed on the gear of the gear train. The at least one camming member may be a first camming member and a second camming member, wherein the first and second camming members capture the lever. The lever may be a follower captured between the first camming member and the second camming member. The media dam is disposed a preselected distance from the lever and along an innermost edge of an input tray and moves between a media stop position and a media pick position.

The device further comprises a media stack disposed adjacent the media dam and has a leading edge engaged by the moveable media dam.

DETAILED DESCRIPTION

Referring now in detail to the drawings, wherein like numerals indicate like elements throughout the several views, there are shown in FIGS. 1–9 various aspects of a moveable media dam device. The device provides two functions. According to a first function, the moveable media dam device provides a positive feedback to a user that a stack of input media is fully inserted into an input media tray. According to a second function, the moveable media dam device clears next-to-top media sheets from the feed zone to inhibit multiple sheet feeds.

Figure 1:
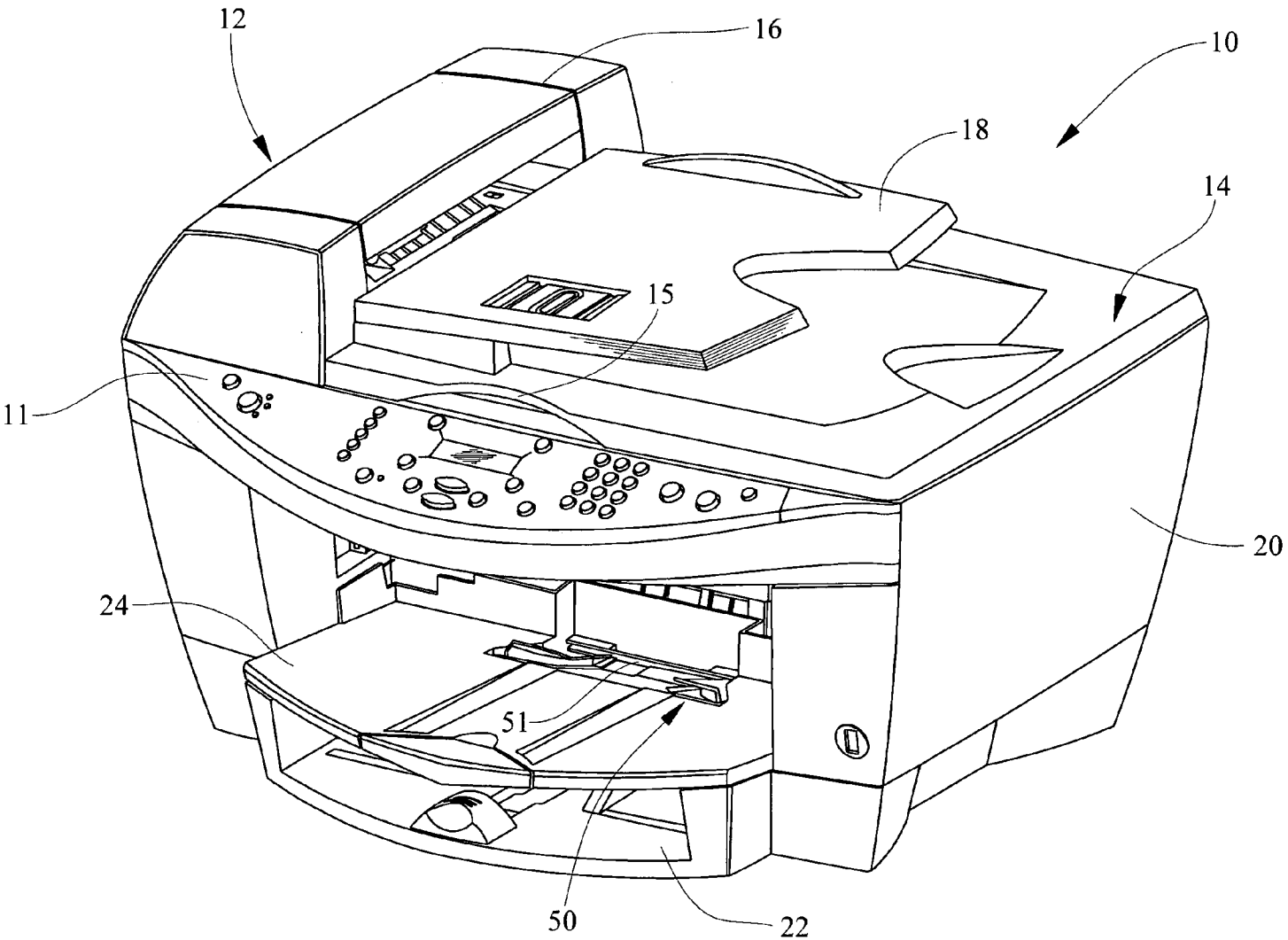
FIG. 1 is a perspective view of an illustrative peripheral device including a media feed system.

Referring initially to FIG. 1, a multi-function peripheral device 10 is shown having a scanner portion 12 and a printer portion generally defined by a housing 20. The multi-function peripheral device 10 is shown and described herein for purpose of clarity, however one of ordinary skill in the art will understand upon reading of the instant specification that the present invention may be utilized with a stand alone printer, copier, auto-document feed scanner, or other device utilizing a media feed system. The peripheral device 10 further comprises a control panel 11 having a plurality of buttons for making selections. The control panel 11 also includes a graphics display to provide a user with menus, choices or errors occurring with the system.

Referring still to FIG. 1, the scanner portion 12 generally includes a lid 14 which is pivotally connected to the peripheral housing along an upper rear edge of the peripheral housing 20. Beneath the lid 14 may be a transparent platen for placement and support of target or original documents for manually scanning. Along a front edge of the lid 14 is a handle 15 for opening of the lid 14 and placement of the target document on the transparent platen (not shown). Adjacent the lid 14 is an auto-document feeder 16 which automatically feeds and scans stacks of documents which are normally sized, e.g. letter or A4, and suited for automatic feeding. Above the lid 14 and adjacent an opening in the auto-document feeder 16 is an auto-document feeder input tray 18 which supports the target documents to be fed to the auto-document feeder 16. Beneath the input tray 18, the lid 14 also functions as an output tray for receiving documents fed through, and scanned by, the auto-document feeder 16.

Within the scanning portion 12 is an optical scanning unit having a plurality of parts which are not shown but generally described herein. The scanning unit may comprise a scanning motor and drive which connects the scanning motor and a scan bar. The scan bar is driven bi-directionally along a scanning axis defined as the direction of the longer dimension of the lid 14 and a scanner bed there beneath. At least one guide bar may be disposed within the scanner bed and may extend in the direction of the scanning axis to guide the scanning unit along the scanning axis. The scan bar moves along the at least one guide bar within the scanner bed beneath the platen. The scan bar may include a lamp, an image sensor, and a mirror therein for obtaining a scanned image from a document. The image sensor may be an optical reduction type image sensor or a contact image senor (CIS) as is known in the art. In either event, the image sensor then determines the image and sends data representing the image to onboard memory, a network drive, or a PC or server housing, a hard disk drive or an optical disk drive such as a CD-R, CD-RW, or DVD-R/RW. Alternatively, the original document may be scanned by the optical scanning component and a copy printed from the printer portion 20 in the case of a multi-function peripheral device 10.

Still referring to FIG. 1, the printer portion 20 comprises an input tray 22 and an exit tray 24 disposed above the input tray. As previously described such arrangement is commonly referred to as a C-path feed device and is aesthetically pleasing because the input media is partially surrounded and hidden from view. Both the input tray 22 and the exit tray 24 extend from the printer portion housing. The exit tray 24 further comprises a small media guide-in tray 50 having a guide-in tray aperture or slot 51 located at the rear portion of the exit tray 24.

Figure 2:
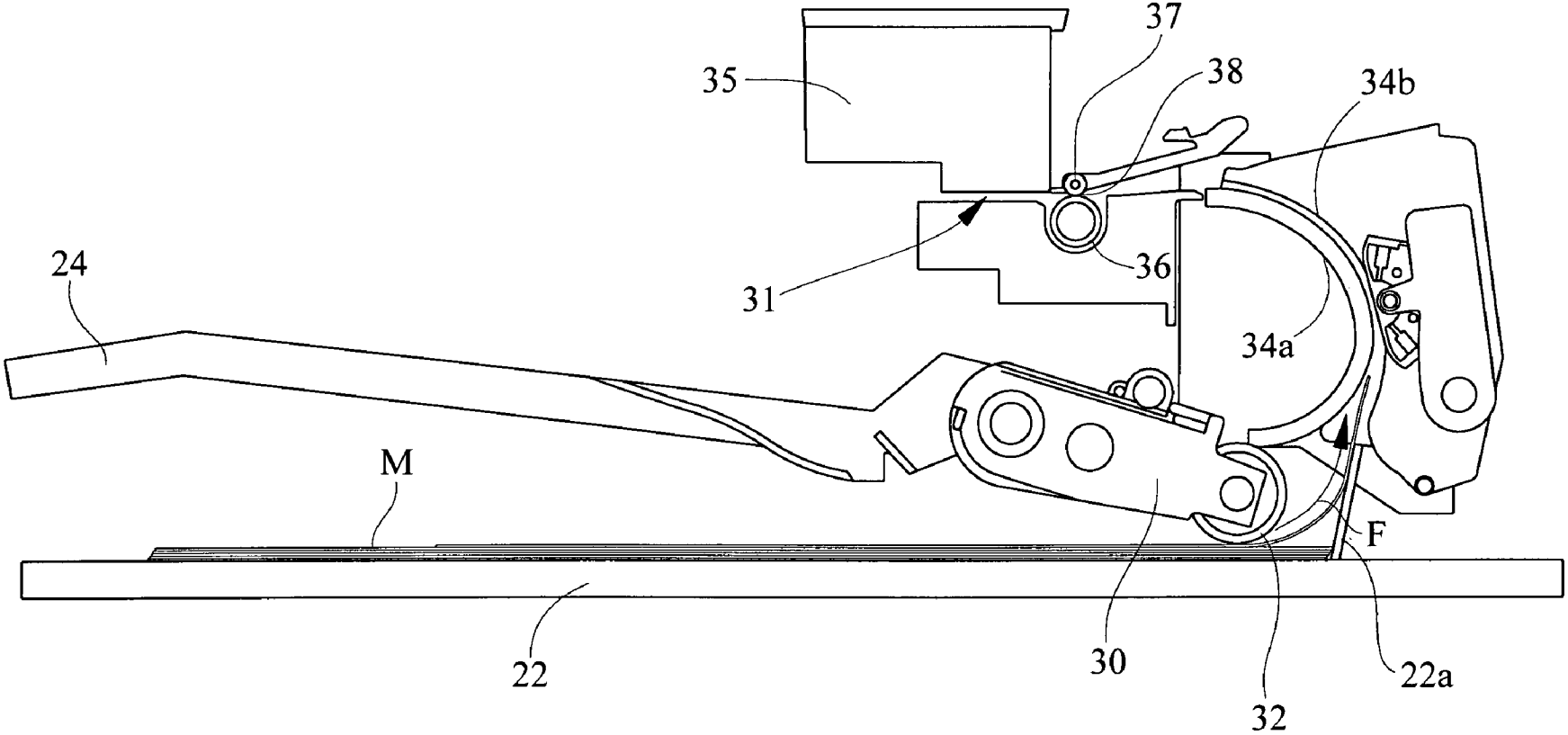
FIG. 2 is a side view of a media feed mechanism and printing zone.

Referring now to FIG. 2, a side view of the feed mechanism is depicted revealing the C-path media feed mechanism of the peripheral device 10 (FIG. 1) with some detail removed for clarity. A plurality of media M is disposed on the input tray 22 at a lower portion of the feed mechanism. The rear or innermost wall of the media tray 22 is defined by an inclined wall 22*a*. The inclined wall 22*a* is partially defined by a plurality of stationary media dams 23 shown in FIGS. 3 and 7–9. Generally, the media M is picked by a paper picking mechanism, such as auto-compensating mechanism 30, and directed upwardly by a pick tire 32 connected to the auto-compensating mechanism 30. The media is fed upwardly through the feed path F between an inner media guide 34*a* and an outer media guide 34*b* until the media reaches a feed nip 38 defined by a feed roller 36 and a feed idler 37. As the media is fed by the feed roller 36 to a print zone 31, a print cartridge 35 is signaled by a print controller to selectively eject ink droplets onto the media passing therebelow. The print cartridge 35 translates along a path substantially transverse to the feed path F, for example, through a plane extending into and out of the page. As the media passes beneath the cartridge 35, the ink droplets are ejected by heat or pressure pulses onto the media producing a desired image. As the media advances through the print zone 31, the media exits the feed path F and is released onto the exit tray 24.

Figure 3:
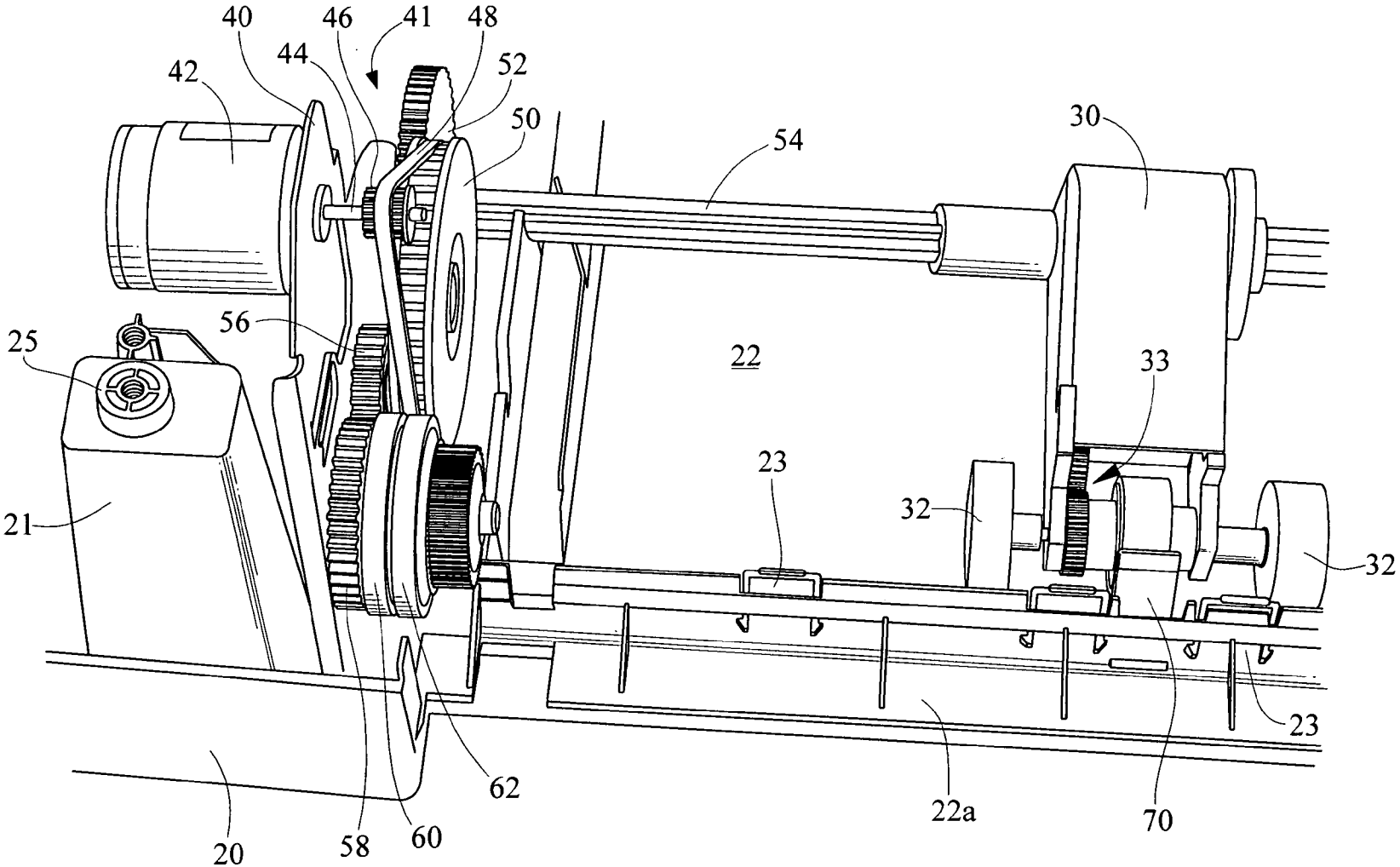
FIG. 3 is an upper perspective view of the media feed system including gear train of the peripheral device of FIG. 1.

Referring now to FIG. 3, an upper perspective view of the feed mechanism is shown including the gear train 41 driving the feed mechanism. Disposed within the housing 20 is a housing column 21 used for connection of upper and lower housing portions as shown by the fastening aperture 25 along the upper surface of the column 21. Adjacent the housing column 21 is a gear train mounting plate 40 having a pick motor 42 on an outer side and the gear train 41 on an inner side. Extending from the pick motor 42 and through the gear train mounting plate 40 is a shaft 44. Disposed on the pick motor shaft 44 is a media indexing pulley 46 having a belt 48 extending around the indexing pulley 46 and further extending around an automatic sheet feeder pulley 50. The belt driven pulley 50 transmits rotational torque to an automatic sheet feeder pulley gear (not shown) on a rear surface of the automatic sheet feeder pulley 50 which engages a primary pick up gear 52. An auto-compensating mechanism (ACM) drive shaft 54 extends from the primary pick up gear 52 to the auto-compensating mechanism 30 in order to drive at least one pick tire 32 via pick tire drive 33. As shown in the present illustrative embodiment, the auto-compensating mechanism 30 includes two pick tires 32 in order to pick input media from the media tray 22. Further, the media tray 22 includes an angled rear wall 22*a* comprising a plurality of stationary media dams 23. The rear wall 22*a* and media dams 23 are angled about 22 degrees from the vertical and form an obtuse angle with the lower horizontal surface of the media tray 22 to direct the media from the input tray 22 into the feed path F as the auto-compensating mechanism 30 picks the media from the media tray 22. According to the present embodiment, the pick rollers or tires 32 and media stack are not spring loaded against one another. Instead the pick tires 32 are mounted on the auto-compensating body and rest on the media stack. When the pick motor 42 and ACM shaft 54 rotate, torque is transferred to the pick tire drive 33. In turn the ACM 30 rotates toward the media and the pick tires 32 rotate, picking an uppermost media sheet. The rotation of the auto-compensating mechanism 30 toward the media generates a normal force which is dictated by the buckling resistance of the media being picked. The magnitude of this normal force is what is required to buckle a single sheet of media plus that needed to overcome the friction resistance between the first and second sheets. Thus, when the uppermost sheet has moved, the normal force automatically decreases and the auto-compensating mechanism 30 delivers only that normal force required to feed a single sheet of media. According to one design of an auto-compensating mechanism, the ACM may utilize a clutch to allow the tire or pick roller 32 to rotate freely once the print media is indexed in a media feed direction through, for example, the print area.

From a rear surface of the automatic sheet feed drive pulley 50, the automatic sheet feeder pulley gear (not shown) also engages a secondary idler 56 which, in turn, drives a secondary compound gear 58. The secondary compound gear 58 includes a first gear 58*a* (FIG. 4) which is driven by the secondary idler 56 and a second gear 58*b* (FIG. 4) which drives a second auto-compensating mechanism (not shown) disposed within the feed path. Operably engaging the secondary compound gear 58 is an arm ring 60 which frictionally engages the secondary compound gear 58. A media stop spring clip 62 retains the arm ring 60 on the secondary compound gear 58. As the pick motor 42 turns in a first direction and drives the secondary compound gear 58, a moveable media dam 70 rotates from a first media stop position to a second media pick position. By reversing the direction of the pick motor 42, the media dam 70 is rotated from the media pick position to the media stop position. As described further herein, the pivotal motion of the moveable media dam 70 clears a feed zone by aligning the leading edges of the media stack to inhibit multi-sheet feeds. Further, when in the first media stop position, the media dam provides a positive feed back position to notify the user that the media has been fully inserted into the media tray 22.

Figure 4:
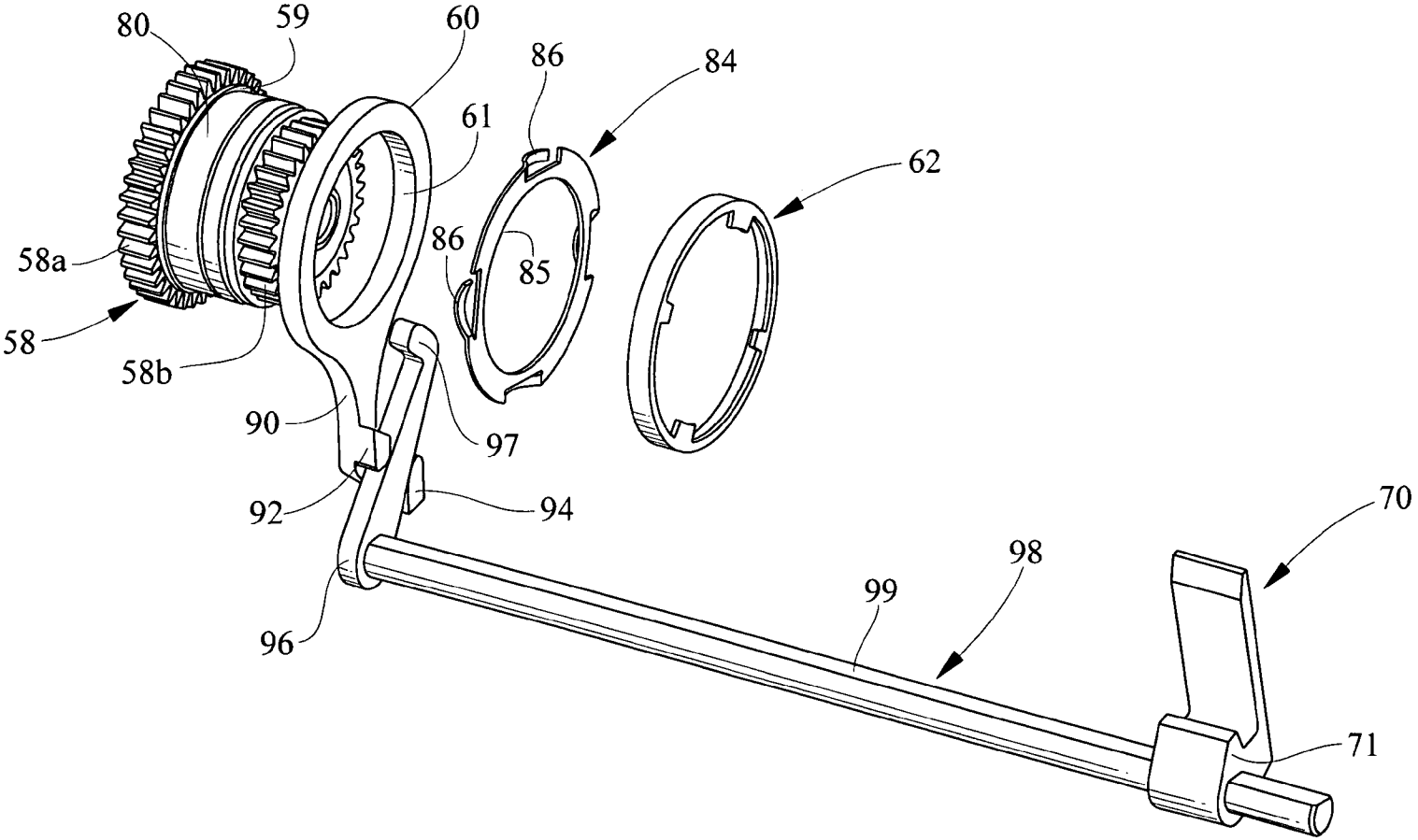
FIG. 4 is an exploded view of the moveable media dam assembly of the present invention.

Referring now to FIG. 4, an exploded perspective view of the components defining the moveable media dam assembly is shown with all other parts removed for clarity. The secondary compound gear 58 is shown comprising a lip 59 and an arm ring engagement surface 80 having a slightly smaller diameter than the lip 59. The larger lip diameter forms a step from arm ring surface 80 to the lip 59. The arm ring engagement surface 80 is a substantially smooth surface as will be further described hereinafter. The gear 58 may vary in diameter and number of teeth depending on the desired rotation and speed, as will be understood by one of ordinary skill in the art. An arm ring 60 is circular in shape corresponding to the engagement surface 80 and includes a central aperture 61. The aperture 61 fits over the arm ring engagement surface 80 and therefore has a diameter which is slightly larger than the arm engagement surface 80 in order to slide over the arm engagement surface 80 and against the lip 59. Otherwise stated, the arm ring aperture diameter is less than the outer diameter of the lip 59 so that a vertical surface of the lip 59 engages a rear substantially vertical surface of the arm ring 60. The inner surface of the central aperture 61 is smooth and engages the smooth surface of the arm ring engagement surface 80 so that there is little friction between the arm ring 60 and engagement surface 80.

The assembly further comprises a spring 84 which is substantially circular in shape having a hollowed out central portion 85 and a plurality of outwardly depending tabs 86 about the periphery of the spring 84. The spring 84 is positioned over the arm ring engagement surface 80 and against the arm ring 60 so that the tabs 86 apply compressive force against the arm ring 60 and forcing the arm ring 60 into the lip 59. Accordingly, the compressive force of the arm ring 60 against the lip 59 provides frictional engagement between the arm ring 60 and the secondary compound gear 58 so that as the gear 58 rotates, the arm ring 60 also rotates therewith. A retaining clip 62 is utilized to retain the axial position of the spring 84 on the secondary compound gear 58. Further, the retaining clip 62 compressively forces the arm ring 60 against the lip 59 and retains the assembly in compression thus providing the frictional engagement between the arm ring 60 and lip 59. The retaining clip 62 may be a media stop spring clip as previously described. Since the arm ring engagement surface 80 and arm ring inner surface 61 are smooth, friction is created between the lip 59 and the arm ring 60. As a result when the dam 70 is in a media pick position and the pick motor 42 (FIG. 3) continues to rotate to pick the media, the secondary compound gear 58 continues to rotate and turn relative to the stationary arm ring 60, an arm 90, and lever 96. Alternatively, when the pick motor 42 rotates in an opposite direction, the motor 42 may continue to rotate and the secondary compound gear 58 may rotate relative to the arm ring 60 although the dam 70 stops at its media stop position.

Radially depending from the arm ring 60 is the arm 90 integrally formed with the arm ring 60 that may vary in shape. Extending from the arm 90 is at least one member, for example 92, and one elbow 91 where the angle of the arm 90 changes providing for improved camming of the lever 96 as will be described further hereinafter. More specifically, an upper member 92 and a lower member 94 extend from the arm 90 in an opposed and spaced apart relationship. The upper member 92 is substantially quadrilateral in shape with a chamfered upper surface and a radiused edge between two surfaces. The radiused edge engages a lever 96 adjacent to the upper member 92 through a preselected arcuate distance. The lower member 94 is also substantially quadrilateral in shape including a radiused engagement surface with the lever 96. The elbow 91 provides a preselected spacing necessary for proper operation described further herein. The upper and lower members 92, 94 comprise curved surfaces which capture and engage a lever 96 extending through the space between the upper member 92 and the lower member 94. The lever 96, mounted on shaft 98, includes an upper rib 97 extending substantially perpendicular from lever 96 which is engaged by the upper member 92 when the moveable dam 70 is at a media stop or upright position and locks the moveable media dam 70 in that upright position (see FIG. 5). The moveable dam 70 may be substantially rectangular in shape and comprises a base portion 71 connecting the dam 70 to the shaft 98. The shaft 98 extends from the lever 96 and transmits motion from the lever 96 to the moveable media dam 70 in order to move the media dam 70 between the first position media stop position and the second media pick position. The shaft 98 may include a flat surface 99 in order to transmit torque from the lever to the moveable media dam 70. Alternatively, various other designs may be utilized to transmit torque from the shaft 98 to the moveable media dam 70. For instance, a collar with a set screw connected to the moveable media dam 70 may be utilized to connect the shaft to the moveable media dam as well as frictional engagement between the moveable media dam 70 and the shaft 98.

Figure 5:
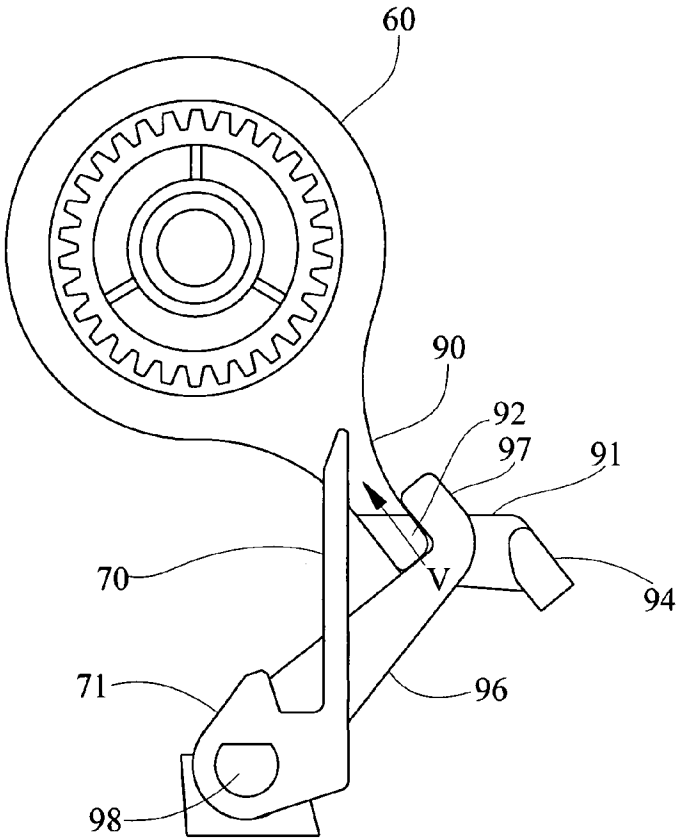
FIG. 5 is a side view of the moveable media dam of FIG. 4 in a first position.

Referring now to FIG. 5, a side view of the moveable media jam assembly is shown. The moveable media dam 70 is shown in a first media stop position for loading of input media. The first member 92 and opposed second member 94 are spaced apart defining a location wherein the lever 96 passes therebetween. As shown in FIG. 5, the first member 92 is received within the recess defined by lever 96 and rib 97 locking the lever 96 in place. When the first member 92 is disposed within the recess the lever 96 is locked from rotating in a counter-clockwise direction. Thus when media is loaded and forced against the damn 70, neither the lever 96, nor the dam 70, can rotate. This provides the user with positive feedback that the media is fully inserted into the media tray 22 (FIG. 3) and inhibits the media from moving upwardly along the moveable media dam 70 and into a feed zone. More specifically, the lever 96 engages the lower surface of the first member 92 creating a substantially upwardly directed force vector V extending through the arm and the center of the gear. Since, the force vector V does not create a moment about the pivoting point of the arm ring 60 and the arm ring 60 cannot rotate inhibiting movement of the lever 96 and rotation of the moveable media dam 70. In this position, media cannot move past the media dam 70 and into the feed zone.

Figure 6:
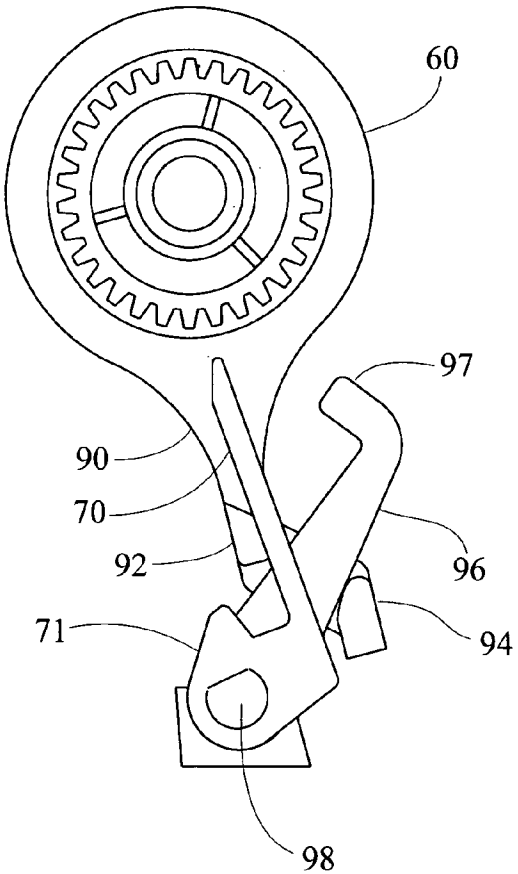
FIG. 6 is a side view of the moveable media dam of FIG. 5 in a second position.

Referring now to FIG. 6, the arm ring 60 is depicted as rotated in a clockwise direction from its position shown in FIG. 5. As a result, the moveable media dam 70 is rotated counter-clockwise in a pick position allowing media to advance from the media tray 22 to a feed path. As shown, the second or lower member 94 engages the lever 96 along a lower lever surface urging the lever 96 in a counter-clockwise rotation. Specifically, as the lever 96 is urged upwardly in a counter-clockwise direction by the second member 94, the lever 96 slides between the first and second members 92, 94 such that the second member disengages the lever 96 from its locked position in FIG. 5. More specifically, as the arm 90 moves in a clockwise direction the first member 92 is removed from the recess defined between rib 97 and the lever 96 allowing the lever 96 to rotate. The second member 94 engages a lower surface of the lever 96 to urge the lever 96 and dam 70 in a counter-clockwise direction for media picking. After a media sheet is fed by the media auto-compensating mechanism 30 and passes the moveable media dam 70, the pick motor 42 (FIG. 3) is reversed causing the gear train 41 to drive the arm ring 60 in a counter-clockwise direction so that the first member 92 engages the upper surface of the lever 96 and rotates the media dam 70 in a clockwise direction to a media stop position as shown in FIG. 5.

Alternatively, the first member 92 and second member 94 may be thought of as cam surfaces and the lever 96 may be thought of as a follower. When the cam 92 rotates in a counter-clockwise direction the follower moves in a clockwise direction until the parts are locked as shown in FIG. 5. Alternatively, when the cam 94 rotates in a clockwise direction the follower 96 rotates in a counter-clockwise direction toward a picking position allowing media to pass from the media tray to the feed zone. In either event, the radiused surfaces of the first and second camming members 92, 94 engage the lever 96 to impart motion on the moveable dam 70.

When the first member 92 engages the rib 97 the arm ring 60 stops rotating as the friction between the arm ring 60 and the lip 59 is overcome by the secondary compound gear 58. Consequently, the secondary compound gear 58 may continue to rotate when the arm ring 60 and arm 90 have stopped due to the engagement of the first member 92 and rib 97. As previously indicated, once the first member 92 engages the rib 97 the moveable media dam 70 is locked and will not move toward the pick position until the arm ring 60 direction is reversed and the second member 94 engages the lower surface of the lever 96.

Figure 7:
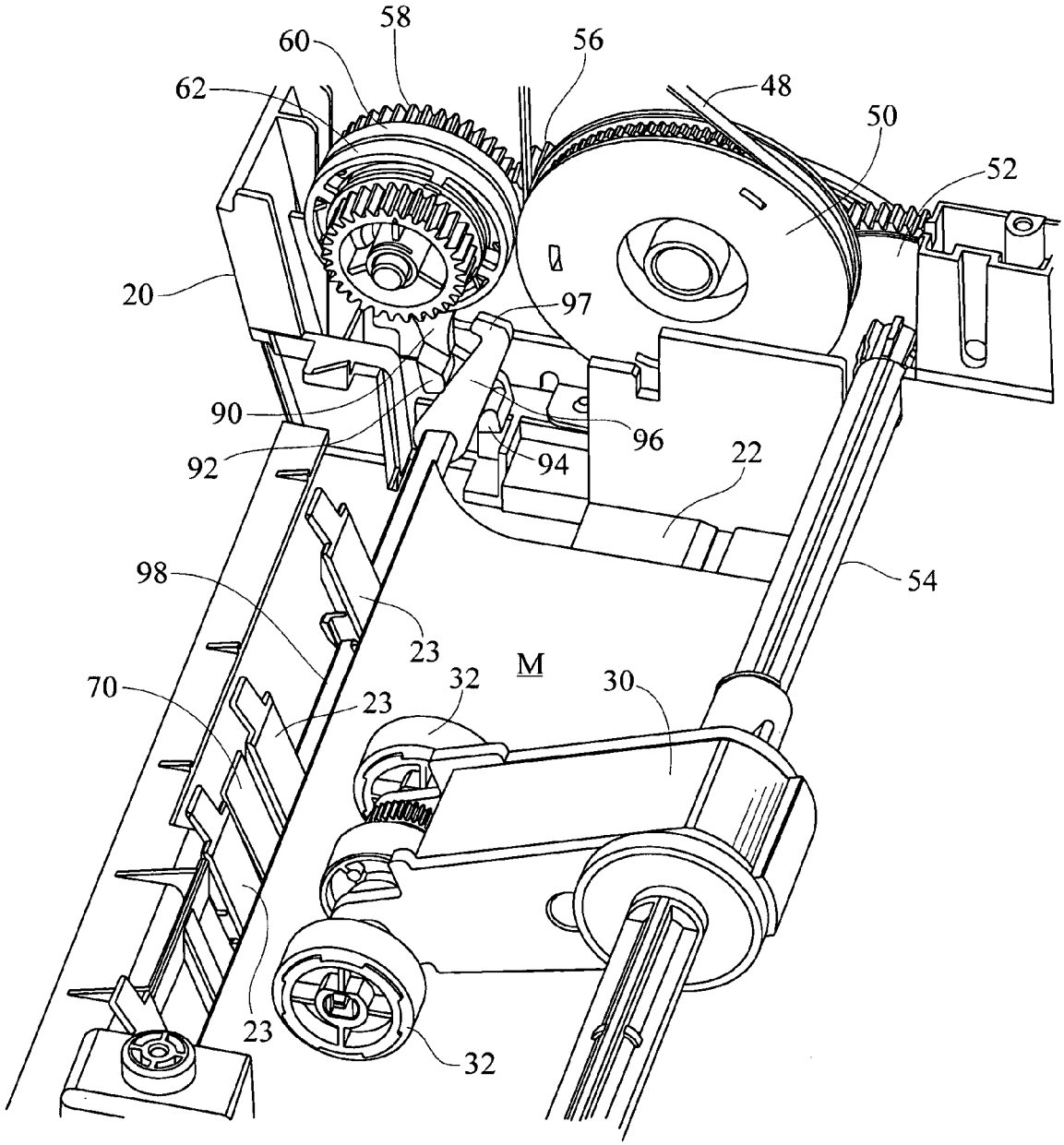
FIG. 7 is a perspective view of the media feed system with the moveable media dam in a second position.
Figure 8:
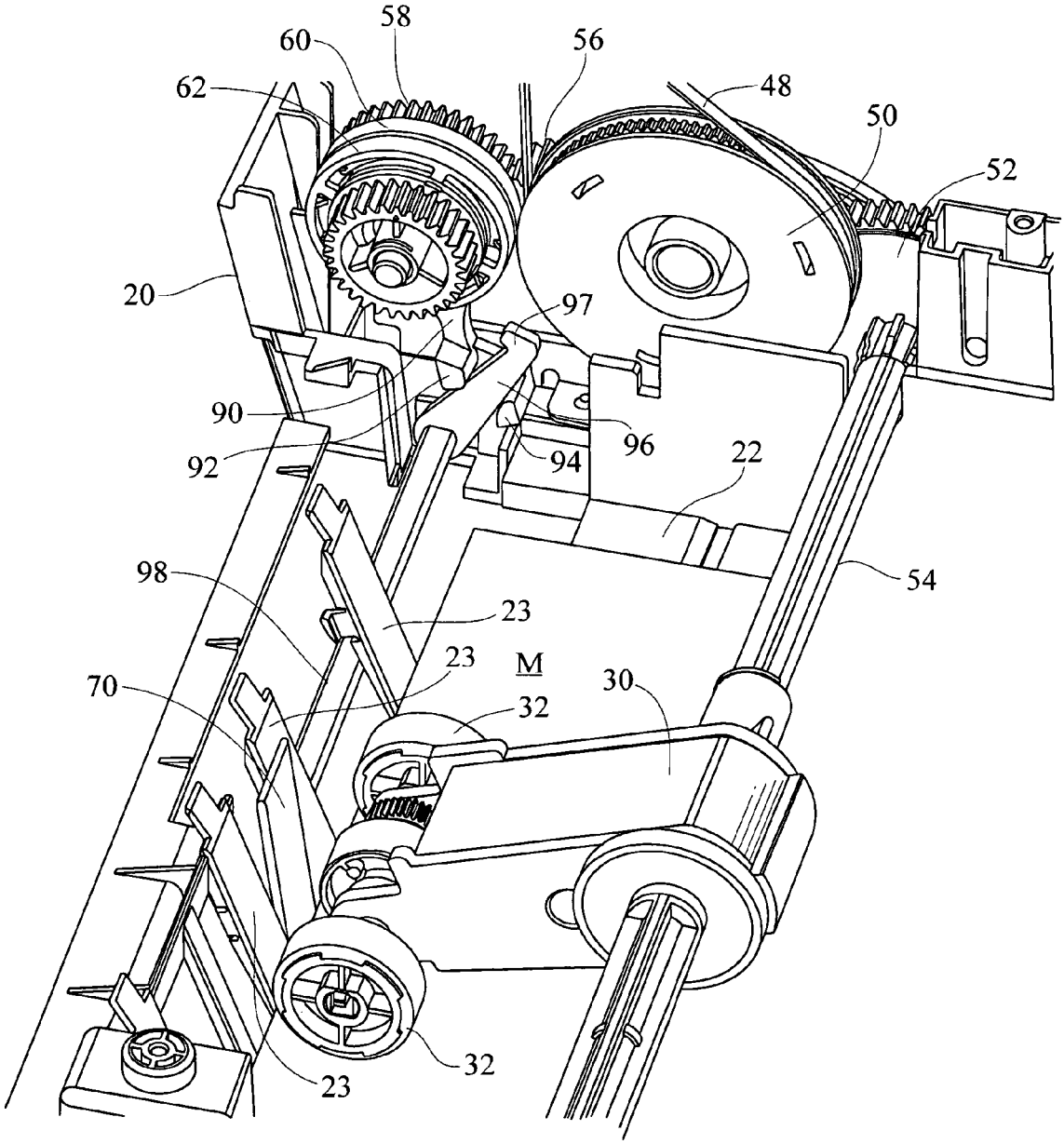
FIG. 8 is a perspective view of the media feed system with the moveable media dam moving toward a first position; and, FIG. 9 is a perspective view of the media feed system with the moveable media dam in a first position.
Figure 9:
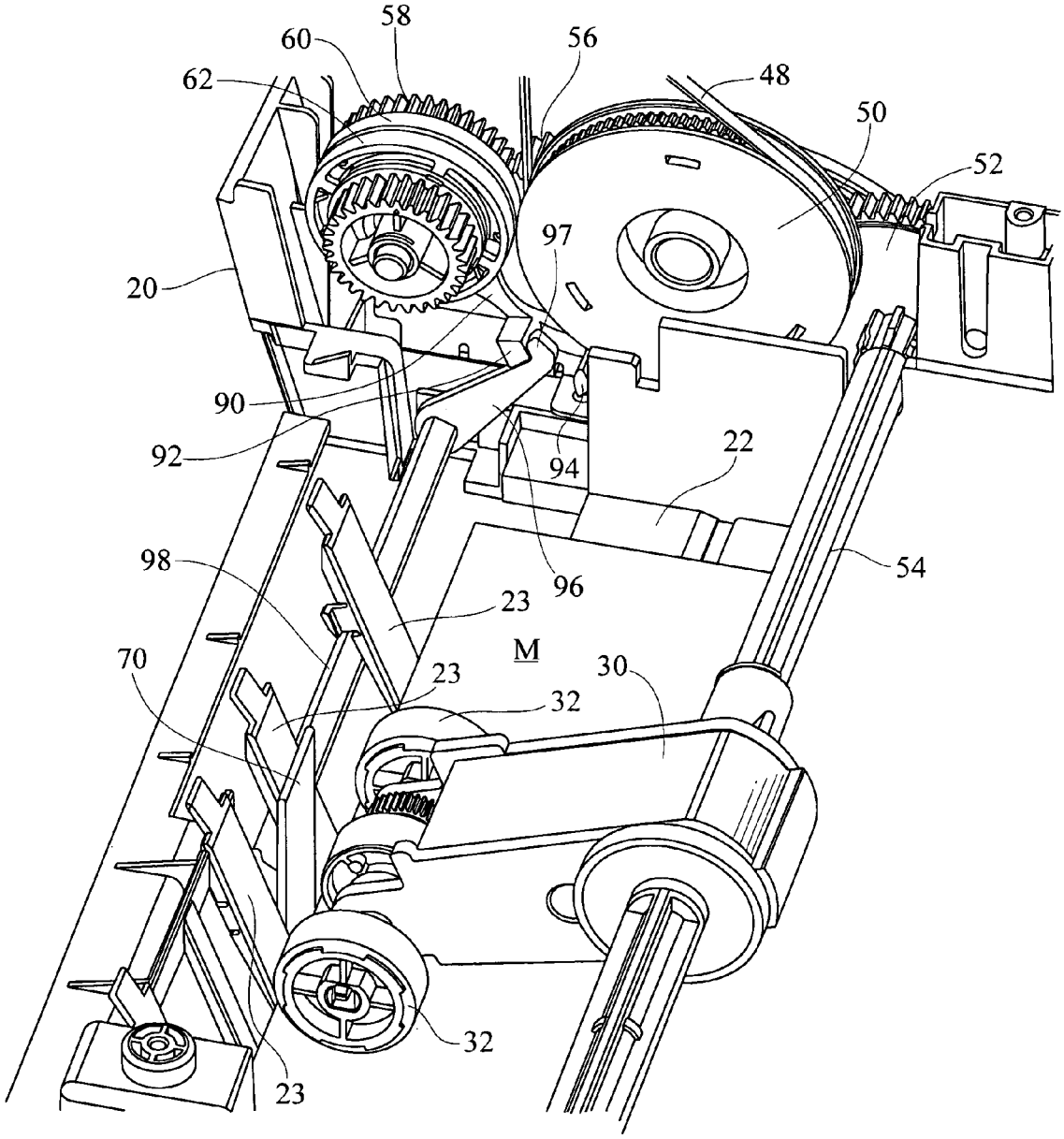

Referring now to FIGS. 7–9, the operation of the device is shown in the perspective views. According to the embodiment depicted in FIG. 7, the moveable media dam 70 is disposed in a feed position so that the media M is picked and moved upwardly along the dam 70 by the ACM 30 and the pick tires 32. The pick motor 42 (FIG. 3) drives the belt 48 which turns the automatic sheet feed drive pulley 50 and primary pick up gear 52. As the primary pick up gear 52 rotates, the auto-compensating mechanism shaft 54 transfers rotation to drive the auto-compensating mechanism 30 and pick tires 33.

Once the upper most media M passes the media dam 70, the pick motor 42 (FIG. 3) rotates in a second direction so that the secondary compound gear 58 is driven in a counter-clockwise direction. As the secondary compound gear 58 rotates, the arm ring 60 is turned with the secondary compound gear 58 in a counter-clockwise direction thus turning the arm 90 in a counter-clockwise direction. With the arm 90 rotating downwardly in a counter-clockwise direction, the lever 96 rotates in a clockwise direction causing the first member 92 to engage the upper surface of the lever 96 and rotate the lever 96 upwardly in a clockwise direction. As previously indicated, the dam shaft 98 extends from the lever 96 and therefore rotates with the lever 96 as the lever 96 is engaged by the first member 92. As the dam shaft 98 rotates in a clockwise direction, the moveable dam 70 rotates back to a position shown in FIG. 8 which is between the media feed position of FIG. 7 and the media stop position of FIG. 9. According to the exemplary embodiment, the moveable media dam 70 rotates through an angle of about 22 degrees although this angular distance is merely exemplary and may vary with design of different media feed mechanisms. In moving from the position of FIG. 7 to the position of FIG. 8, the moveable media dam 70 moves through an angle of about 11 degrees although the rotation may vary with alternative embodiments and is strictly exemplary. As the pick motor 42 (FIG. 3) continues to rotate in the second direction, the dam 70 pivots to position depicted in FIG. 9.

Referring now to FIG. 9, the pick motor 42 (not shown) has continued rotation of the gear train 41 so that first member 92 engages the rib 97 of the lever 96. With the first member 92 disposed within the angle defined between the upper surface of lever 96 and the rib 97, the lever 96 is locked in position for media feeding. More specifically, the two substantially perpendicular surfaces of first member 92 engage the perpendicular surfaces of the lever 96 and the rib 97, respectively locking the media dam 70 in a fully forward or media stop position. Although the lever 96 is locked, the pick motor 42 may continue to rotate to advance media at a second auto-compensating mechanism (not shown) wherein the secondary compound gear 58 slips relative to the arm ring 60 and arm 90. As previously indicated, application of force from, for example, a media stack on the media dam 70 does not cause the media dam 70 to rotate rearwardly toward the rear wall of the media tray 22. Instead the locking engagement of the lever arm 96, rib 97 and first member 92 inhibits rotation of the lever 96 and therefore inhibits rotation of the moveable media dam 70. In this position, the feed mechanism is ready to begin the process of feeding of a single sheet of print media M from the media input tray 22.

When a signal is sent to rotate the pick motor 42 (FIG. 3) in a first direction, the gear train 41 drives the secondary compound gear 58 in a clockwise direction so that the second member 94 engages the lower surface of the lever 96 and rotates the lever 96 in a counter-clockwise direction thus rotating the moveable media dam 70 in a rearwardly or counter-clockwise direction into alignment with the stationary media dams 23 defining the rear wall of the media input tray 22, as shown in FIG. 7. As the moveable media dam 70 engages the rear wall of the media tray 22. The moveable media dam 70 cannot rotate any further and is aligned with the adjacent stationary media dams. However, the secondary compound gear continues to rotate in a clockwise direction since the design of the arm ring 60 the spring 84 and retaining clip 62 allow the arm ring to slip relative to the secondary compound gear 58 as the pick motor 42 and drive train 41 continue to rotate during the pick process.

Once the media sheet is fed past the moveable media dam 70, the pick motor 42 is rotated in the second direction causing clockwise rotation of the moveable media dam 70 to the media stop position which also aligns the leading edges of the media M thus inhibiting multi-sheet feeds which are common in the prior art.

The foregoing description of several methods and an embodiment of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. In a device having an input tray for media, a moveable media dam, comprising:

a rotatable dam shaft;

a media dam extending from and connected to said dam shaft and moveable between a first position and a second position;

a lever extending from and connected to said dam shaft;

an arm for rotatably moving said dam shaft and having at least one camming member, said camming member engaging said lever; and, arm moving means for moving said arm in a first direction and in a second direction to rotatably move said dam shaft.

2. The moveable media dam of claim 1 wherein said media dam is disposed a preselected distance from said lever.

3. The moveable media dam of claim 1 wherein said media dam in said first position is disposed adjacent an innermost wall of said input tray.

4. The moveable media dam of claim 1 wherein said media dam in said second position engages a leading edge of said media.

5. The moveable media dam of claim 1 wherein the arm moving means further comprises a gear train with said arm having an arm ring disposed over a gear of said gear train.

6. The moveable media dam of claim 5, where said gear has an arm ring engagement surface with said arm ring engaging said arm ring engagement surface.

7. The moveable media dam of claim 1 further comprising a retaining spring disposed on a gear of a gear train and retaining said arm therebetween.

8. The moveable media dam of claim 1 wherein said at least one camming member further comprises a first camming member and a second camming member.

9. The moveable media dam of claim 8 wherein said first and second camming members engage said lever therebetween.

10. The moveable media dam of claim 1 further comprising said at least one camming member being an upper camming member and a lower camming member with said lever being a follower captured between said upper and lower camming members.

11. The moveable media dam of claim 1 wherein said first position is a media stop position and said second position is a media pick position.

12. In a device having an input tray for holding a stack of media to be fed into said device, a moveable media dam, comprising:

a pick motor;

a gear train driven by said pick motor;

at least one arm frictionally engaging said gear train with said arm including at least one camming member;

a media dam rotatably moveable between a first position and a second position; and, a lever engaging said at least one camming member and connected to said media dam whereby rotational movement of said gear train, arm and lever move said media dam between said first position and said second position.

13. The moveable media dam of claim 12 further comprising an arm ring frictionally engaging at least one gear of said gear train and being integral formed with said arm.

14. The moveable media dam of claim 12 further comprising a retaining clip adjacent said arm for holding said arm in engagement with said gear train.

15. The moveable media dam of claim 12 wherein said at least one member comprises two spaced apart camming members capturing said lever between said two camming members.

16. The moveable media dam of claim 12 further comprising a shaft connecting said lever to said media dam.

17. The moveable media dam of claim 12 wherein said first position is a media stop position and said second position is a media pick position.

18. The moveable media dam of claim 12 further comprising said arm having an arm ring integrally formed therein with said at least one gear frictionally engaging said arm ring.

19. The moveable media dam of claim 18 wherein said at least one gear is slidable relative to said arm ring when said moveable dam is disposed in either of a first position or a second position.

20. The moveable media dam of claim 12 wherein said media dam in said second position clears said media from adjacent a feed zone and aligns leading edges of said media.

21. A moveable media dam, comprising:

a gear train;

an arm frictionally engaging at least one gear of said gear train;

said arm having an upper camming member and a lower camming member;

a cam follower disposed between said upper and lower camming members and moveable between a first position and a second position; and, a shaft extending from said cam follower and having a media dam disposed thereon at a preselected distance from said cam follower;

said media dam rotatably moveable between said first and second positions.

* * * * *